United States Patent [19]

Rehrig et al.

[11] 4,011,948

[45] Mar. 15, 1977

[54] EGG CRATE

[75] Inventors: Houston Rehrig, Pasadena; Bud E. Sanders, North Hollywood, both of Calif.

[73] Assignee: Rehrig Pacific Company, Los Angeles, Calif.

[22] Filed: July 7, 1975

[21] Appl. No.: 593,253

Related U.S. Application Data

[63] Continuation of Ser. No. 321,591, Jan. 8, 1973, abandoned.

[52] U.S. Cl. ..... 206/507; 206/515

[51] Int. Cl.[2] ..... B65D 21/01

[58] Field of Search ..... 206/507, 513, 515, 518, 206/519, 520, 505, 506, 507

[56] References Cited

UNITED STATES PATENTS

| | | | |
|---|---|---|---|
| 2,889,072 | 6/1959 | Lopham | 206/507 |
| 3,191,796 | 6/1965 | Schwartz | 206/507 |
| 3,197,058 | 7/1965 | Hale | 206/507 |
| 3,270,913 | 9/1966 | Bridenstine | 206/507 |
| 3,351,228 | 11/1967 | Huisman | 220/66 |
| 3,481,507 | 2/1969 | Sanders | 206/507 |
| 3,773,213 | 11/1973 | Frederick | 206/507 |

*Primary Examiner*—George E. Lowrance

[57] ABSTRACT

A molded plastic crate for eggs packaged in cartons and adapted to receive a plurality of layers of multiple cartons in a manner to releasably retain and to protect the individual cartons against damage during handling. The configuration of the crate permits stacking when filled or nesting when empty, resists lateral deflection of the side walls, and facilitates removal of the individual cartons for merchandising the eggs directly from the crate.

13 Claims, 9 Drawing Figures

EGG CRATE

This is a continuation of application Ser. No. 321,591 filed Jan. 8, 1973, now abandoned.

BACKGROUND OF THE INVENTION

1. Field of the Invention

This invention relates to molded plastic crates, and more particularly to an improved molded plastic crate for use in handling and/or merchandising eggs packaged in conventional one-dozen cartons.

2. Description of the Prior Art

It is conventional practice to merchandise eggs in cartons each containing one dozen eggs. The filled cartons are shipped to the retailer in cases or crates each holding a plurality of layers of multiple cartons, typically five layers of three cartons each, or 15 cartons per crate. The typical egg carton is a single piece molded pulp or paperboard carton folded along a horizontal fold line to form the top and bottom portions of the crate, with the closed carton having an outwardly extending flange along the two ends and one side at the juncture of the top and bottom portions.

The crates employed in handling and transporting egg cartons have in the past taken various forms, including wooden slat boxes, wire frame crates and even paperboard cartons, with the wire frame construction being the one most commonly used today. These prior art crates or boxes have not been entirely satisfactory for many reasons. For example, the open construction of the wire frame crate has not always adequately protected the egg cartons from damage through the walls of the crate, whereas the wooden crates and/or paperboard boxes have been easily damaged, difficult or impossible to clean, and generally have not presented an acceptable appearance for use in merchandising eggs directly to the customer. Further, the individual crates and/or boxes have generally not been capable of nesting when empty, making their storage, handling and transportation more difficult and costly.

In recent years, there has been a growing tendency on behalf of retailers to place the filled egg crates on display, and let the customer take the individual cartons of eggs directly from the crates. This practice has resulted in an increased use of the wire frame crate which permits the individual cartons to be price stamped through openings in the side walls of the crate without removing the cartons therefrom. To facilitate removal of the cartons, and to clearly display the contents of the crate to the customer, the crates are normally placed on a shelf or other suitable structure on one side with the open top of the crate lifted to tilt the cartons toward the bottom and thereby prevent them from falling out of the crate. No provisions have generally been made to releasably retain the cartons in place within the crate.

OBJECTS OF THE INVENTION

A primary object of the present invention is to provide an improved egg crate constructed from molded plastic material, preferably molded thermoplastic polymeric material, which avoids the foregoing and other defects of the prior art egg crates, and which presents an attractive and pleasing appearance to the consumer when employed for merchandising eggs directly from the crates.

Another object of the invention is to provide such a molded plastic crate which releasably retains the egg cartons in place within the crate to guard against shifting and damage of the egg cartons during handling and to avoid the tendency of the cartons to tumble out when the crate is placed on its side in a horizontal or near horizontal position.

Another object is to provide such a molded plastic crate which provides maximum protection for the cartons of eggs therein but which nevertheless permits ready viewing and price marking of the individual cartons through the side walls of the crate.

Another object is to provide such a crate having a maximum strength-to-weight ratio to afford maximum protection for the egg cartons while avoiding excessive weight and/or bulk.

Another object is to provide such a crate constructed to engage and releasably retain the individual egg cartons therein while avoiding damage to the cartons.

Another object of the invention is to provide such a crate having minimum outside dimensions to facilitate handling in conventional trucks and which may be stacked when filled or nested when empty.

SUMMARY OF THE INVENTION

The foregoing and other objects are attained in an egg crate according to the present invention in which at least the side walls, and preferably the entire crate is injection molded from a thermoplastic polymeric material (hereinafter, plastic) and having side walls which are inclined outwardly slightly from the bottom and which are constructed to permit stacking of the crates when oriented in the same direction and nesting when rotated through 180° with respect to one another. The side walls of the crate are constructed with alternate inwardly and outwardly offset substantially planar surface portions joined along their adjacent edges by integrally molded flange portions to provide maximum resistance to bending, or deflection of the side walls. Also, the outwardly offset wall portions are inclined outwardly at a slightly greater angle than the inwardly offset portions, thereby permitting these outer wall portions to be slightly thicker in transverse dimension than the inner wall portions while permitting the same extent of telescoping movement of the crates within one another for nesting. The inner and outer wall portions are preferably in the general configuration of isosceles trapezoids whereby the flanges adjoining the adjacent edges of these wall portions are inclined with respect to one another to form a zigzag pattern within the planes of the inner and outer wall portions. Sections of the inner wall portions are removed at spaced intervals along the length thereof on at least two opposed walls to present a relatively narrow strip at each side of the inner wall which is permitted to engage and cut slightly into the conventional flange on the ends of an egg carton to thereby releasably retain the carton in position within the crate.

According to one embodiment of the invention, the crates have a substantially vertically extending band portion around the top of the crate, with the outer surface of the band portion being substantially planar and having elongated ribs formed on the inner surface to provide a shoulder for stacking of other crates thereon and to provide the desired frictional contact with the end flanges of the egg cartons to resist shifting and/or removal.

DESCRIPTION OF THE DRAWINGS

Other objects and advantages of the invention will become apparent from the following detailed description, taken with the drawings, in which.

DESCRIPTION OF THE PREFERRED EMBODIMENT

Figure 1:
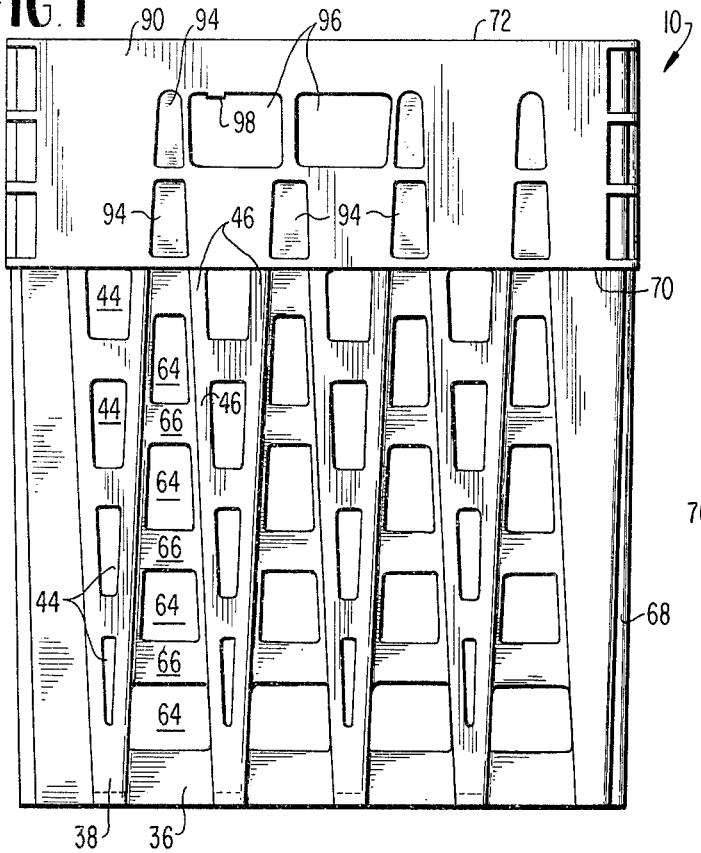
FIG. 1 is a side elevation view of an improved egg crate according to the present invention.

Referring now to the drawings in detail, an egg crate according to the present invention is indicated generally by the reference numeral 10 and is illustrated as being molded from a single mass of plastic material. The crate 10 includes a generally rectangular bottom panel 12 of open grid construction and upwardly directed side walls 14, 16 and end walls 18, 20 extending upwardly from the edges of the bottom panel 12.

Figure 7:
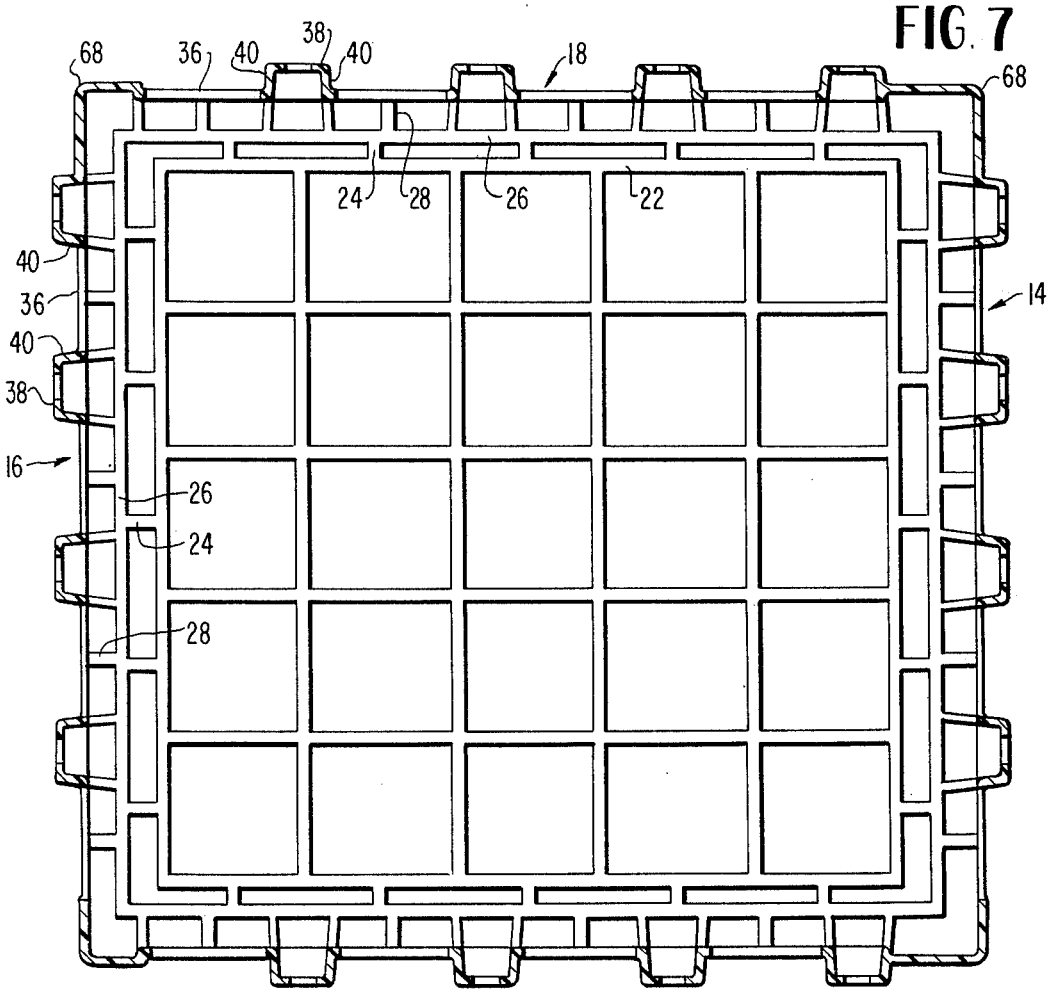
FIG. 7 is a sectional view taken on line 7—7 of FIG. 2.
Figure 4:
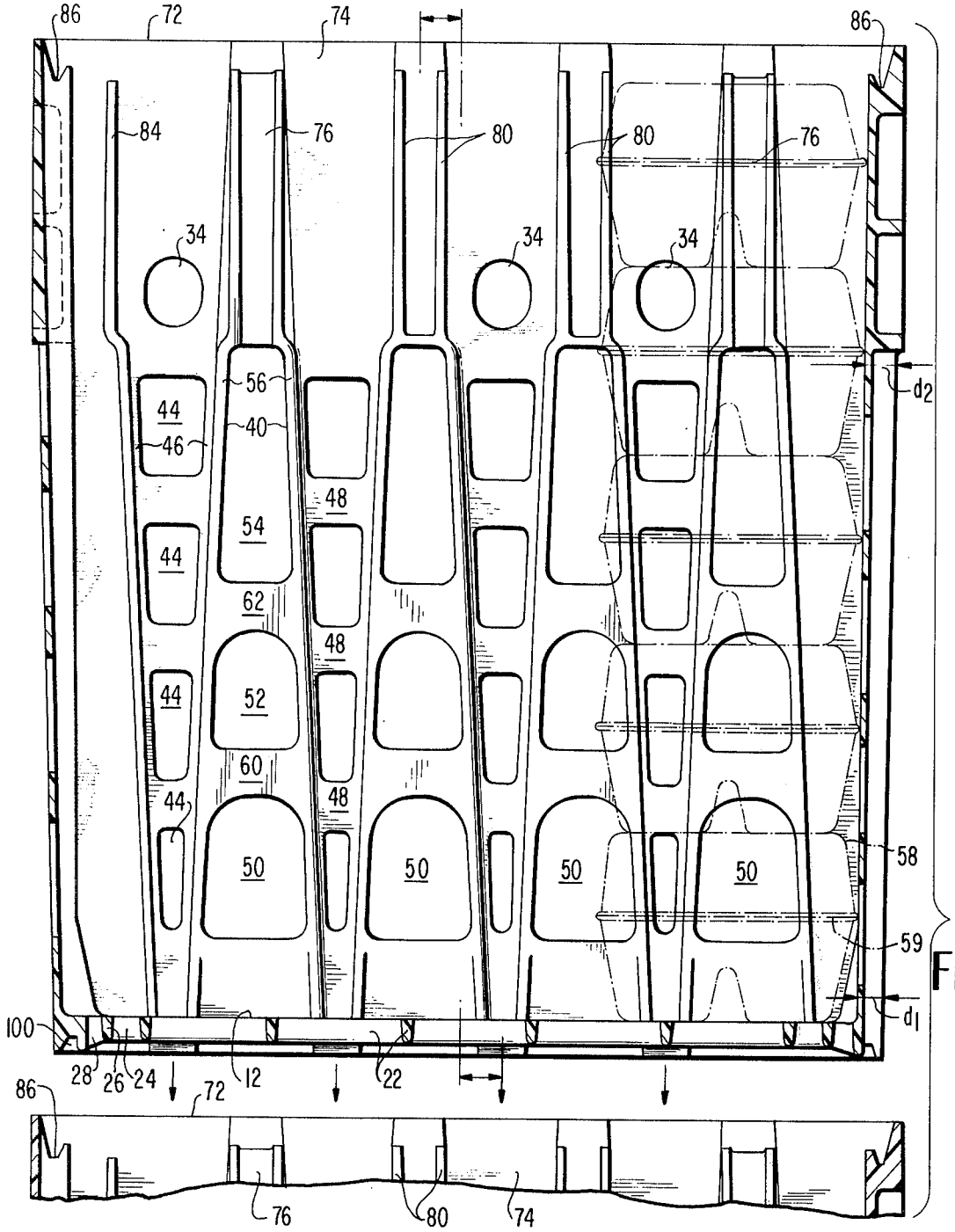
FIG. 4 is a sectional view taken on line 4—4 of FIG. 3.
Figure 8:
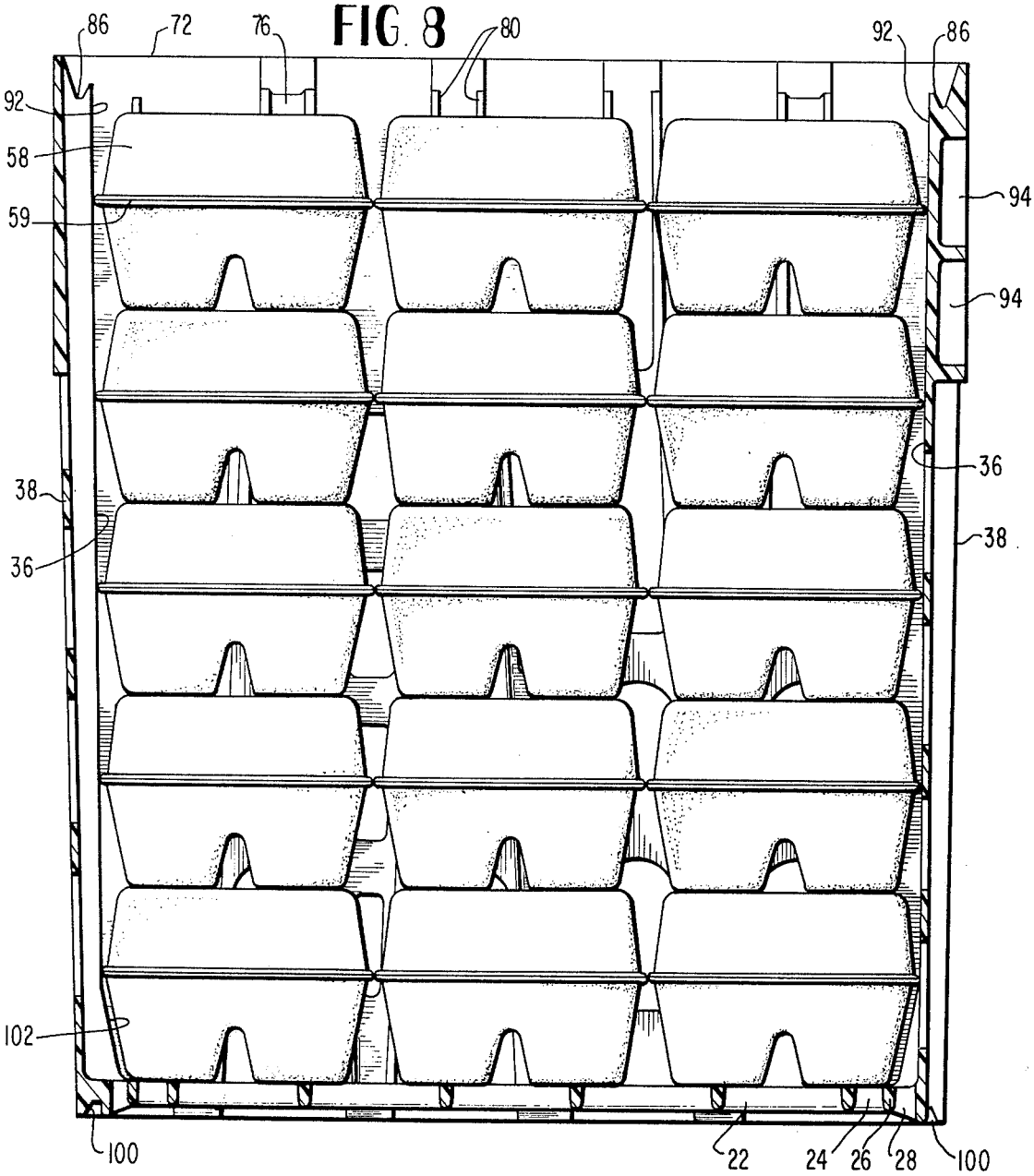
FIG. 8 is an elevation view of the crate, in section, illustrating the arrangement of egg cartons in the crate.

Referring to FIGS. 4, 7 and 8, it is seen that bottom panel 12 is of relatively light section made up of a plurality of perpendicularly arranged, elongated web-like members 22 integrally joined at their respective ends. These web members 22 have their maximum dimension in the vertical plane to provide maximum strength for the bottom panel and their minimum dimension in the plane of the panel to permit limited resiliently resisted deflection or bending within the plane of the panel. The panel 12 is integrally joined to the side and end panels adjacent the bottom of the crate by a plurality of relatively thin gusset members 24 having one end integrally molded to the webs 22 which form the peripheral edges of the bottom panel 12 at a point mid-way between the ends of the respective web members 22. Since the webs 22 are dimensioned for slight resiliently resisted deflection in the plane of the bottom panel 12, the construction will readily accommodate slight differential shrinkage between the bottom panel and the side and end walls which are integrally joined thereto at the other ends of the gusset members 24 by the peripheral web 26 and a plurality of gussets 28.

Figure 2:
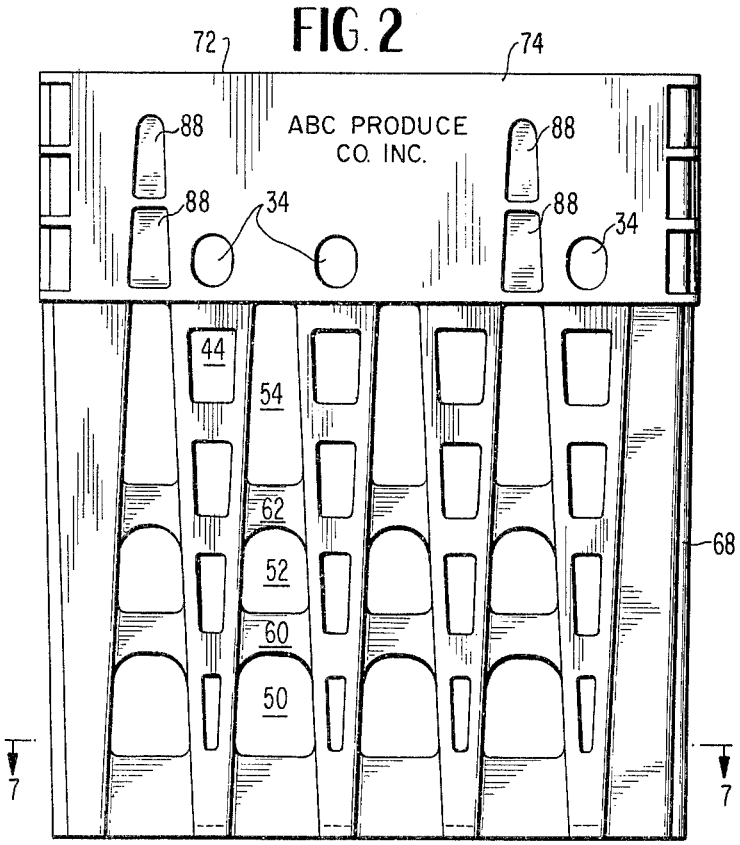
FIG. 2 is an end elevation view of the crate shown in FIG. 1.

Referring now particularly to FIGS. 2, 4 and 7, it is seen that end walls 18, 20 of the crate are substantially mirror images of one another and are asymmetrical with respect to the vertical center plane 30 of the crate bisecting these end walls. Similarly, side walls 14, 16 are substantially mirror images of one another and are asymmetrical with respect to the vertical center plane 32 of the crate bisecting these walls. For purposes of this description, side walls 14, 16 may be assumed to be identical and end walls 18 and 20 may be assumed to be identical except for three generally elliptical marking openings 34 in end wall 20 which are provided to permit price marking of the second from top layer of egg cartons in the crate. By providing these openings only in one end panel, they serve also as an index of indicator for orienting the crates for stacking or nesting. Accordingly, only side wall 14 and end wall 20 will be described in detail, it being understood that the description applies equally to the corresponding side or end wall.

The lower portion of side wall 14 and end wall 20 are made up of alternate inwardly and outwardly offset substantially planar panels 36, 38 joined along their adjacent edges by elongated webs or flanges 40. The offset panels 36, 38 are formed in the general configuration of an isosceles trapezoid with the inner sections having the narrow or short side at the top and the outwardly offset sections having the shorter side at the base of the crate. Thus, the flanges 40 are inclined within the general plane of the side wall, with alternate flanges being inclined in opposite directions with respect to the vertical whereby the series of flanges form, in effect, a zigzag pattern.

In the illustrated embodiment of the crate, there are four equally spaced inwardly offset panel portions and four equally spaced outwardly offset panel portions in each of the side panels 14, 16 end panels 18, 20 with the pattern of inwardly offset panels being itself offset, in the general plane of the end wall, to one side of the vertical center planes 30, 32 and the pattern of outwardly offset portions being itself offset in the opposite direction with respect to the vertical center planes.

The outwardly offset panel portions 38 each have a plurality of spaced, generally rectangular openings 44 formed therein for the purpose of reducing the overall weight of the crate and to provide a clearer view of the contents of the crate. In addition, the elimination of a portion of the planar surface of the outwardly offset wall section greatly reduces the surface friction between this wall section and a similar or corresponding wall section of another crate nested therein, thereby facilitating the separation of nested crates. It is pointed out, however, that the openings 44 do not extend the full transverse width of the outwardly offset panel section so that there is left on each side of the respective opening 44 a web portion 46 of sufficient dimension to provide the necessary strength in flexure to prevent outward bending or deflection of the panel under moderate loads, either as a beam or as a column. Also, the intermediate surface portions 48 provide lateral stiffening support for the flange members 40 to prevent buckling of the flanges under bending loads, or loads tending to deflect the end walls of the crate inwardly or outwardly from their normal plane.

Each of the inwardly offset wall panel portions 36 in end panel 20 has a lower opening 50, an intermediate opening 52 and an upper opening 54 formed therein, with these openings extending substantially the full transverse width of the panel 36, leaving only a narrow ledge 56 along the upwardly inclined sides of the respective openings. The lower opening 50 is spaced above the bottom panel 12 a distance substantially equal to half the height of an egg carton to thereby protect the bottom carton against damage during handling of the filled crate. Thus, as can be seen from the egg cartons 58 illustrated in phantom in FIG. 4, the lower edge of bottom opening 50 is positioned just slightly below the centerfold flange 59 of the lowermost egg carton whereas the lower edge of the opening 52 extends just slightly below the flange 59 of the egg carton in the second layer and opening 54 has its lower edge positioned slightly below the flange 59 of the egg carton in the third layer. Thus, the panel portions 60, 62 reinforce the flanges 40 at a point adjacent to and spaced slightly below the point of contact of the end of the individual egg cartons 58. The upwardly extending, narrow ledges engage and cooperate with the end portion of the center flange 59 of the individual cartons to releasably anchor the egg cartons in position within the crate in a manner more fully described hereinbelow.

As seen in FIG. 1, the inwardly offset panels 36 of side wall 14 have a plurality of vertically spaced, generally rectangular openings 64 formed therein and separated by the panel portion 66 for the same general purpose as the openings 44. The openings 44 and 64 are offset with respect to one another so that the panel portions 48 and 64 provide maximum reinforcement for the flanges 40.

Figure 5:
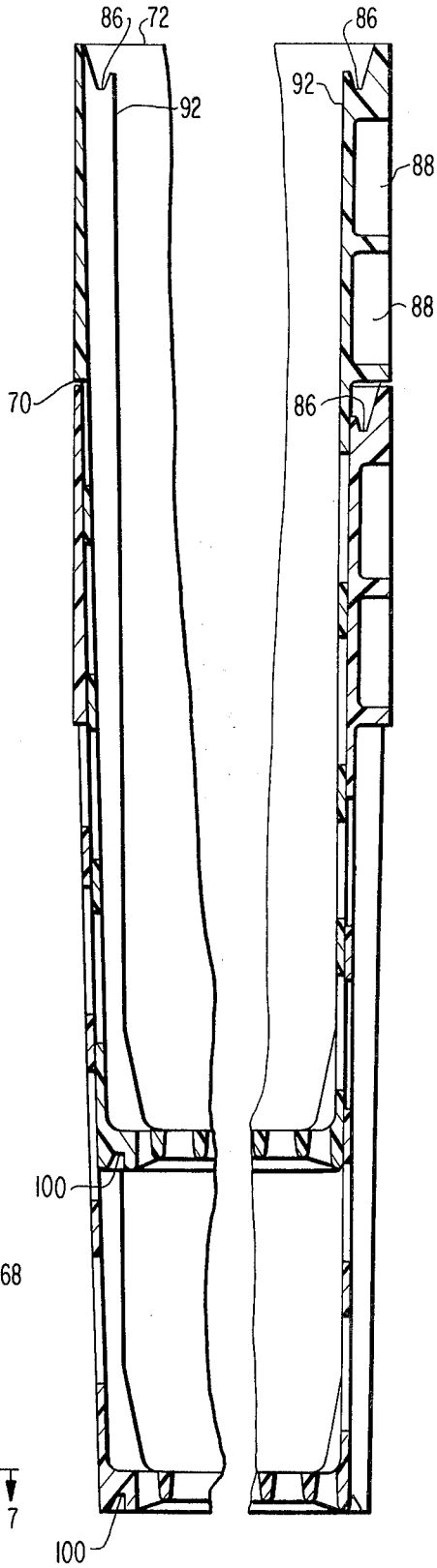
FIG. 5 is a fragmentary sectional view illustrating two of the crates nested together.
Figure 3:
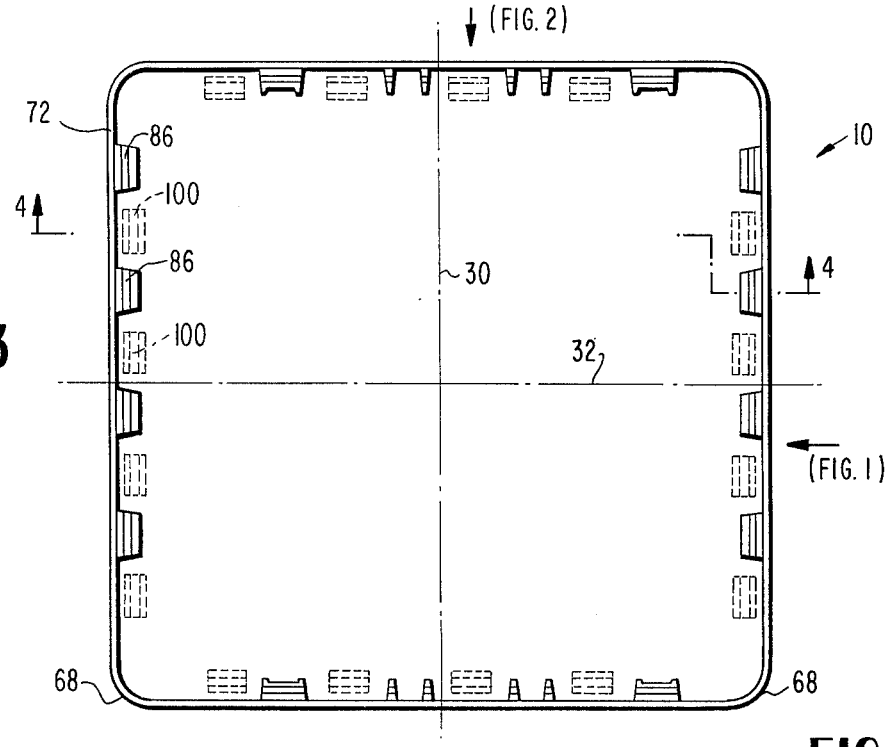
FIG. 3 is a top plan view of the crate shown in FIG. 1, with portions of a second crate oriented in position for nesting being illustrated in phantom.

As most clearly illustrated in FIG. 5, the lower segment of the end panels 18, 20 and side panels 14, 16 are inclined slightly with respect to the vertical, tapering outwardly and upwardly to present a slightly larger cross section at the upper portion of the crate than near the bottom. Also, as seen by comparison of the distances D1 and D2 in FIG. 4, the outwardly offset panel portion 38 are inclined at a slightly greater angle than the inwardly offset panel portions 36. This slight increase in the angle of inclination of the outwardly offset panels 38 makes possible the use of a slightly thicker wall section than is employed in the planar wall section of the inwardly offset panel portion 16 without interferring with the nesting of the crates. At the same time, this slightly increased wall thickness materially increases the strength of the side walls both as a column and as a beam. For the same reason, the flanges 40 which are inclined at a substantially greater angle with respect to the vertical than is the planar section of the offset wall portions, may have a substantially greater thickness. Similarly, the radius of curvature of the end and side wall portions defining the corners of the crate has a larger radius of curvature near the top than near the bottom and is inclined at a greater angle than panel portion 36, making it possible to use a relatively thick section in the corners to reinforce and strengthen the corners of the crate. Preferably, the wall thickness of the flanges 40 and the corners of the crate, and the angle of inclination of thin members is such that they do not come into contact with corresponding parts during nesting so that friction is reduced and the effort required to separate the nested crates is held to a minimum.

The upper portion of the crate, for approximately 30% of the total height of the crate, has vertical side walls having substantially planar outer surfaces both on the ends and sides of the crate, with the upper and lower sections joining at a downwardly directed ledge 70 positioned to engage the top surface 72 of a similar crate when the crates are nested to thereby limit the movement of one crate within the other to approximately 70% of the total crate height. This ratio can, of course, be varied as desired within limits and alternative stop members may be provided on the outside surface of the lower section of the crate to limit telescoping movement of the crates on nesting to somewhat less than the total length of the lower, inclined section.

As seen in FIGS. 4 and 5, the top portion 74 of panels 18, 20 are molded with a pair of inwardly directed protrusions 76, 78 forming, in effect, vertical extensions of the two inwardly offset panels 36 adjacent the outer edges of the panel portions 74 and two upwardly extending pair of ribs 80, 82 forming, in effect, extensions of the ledges 56 on the two inwardly offset panel portions 36 adjacent the center of the panel. Also, a rib 84 forms, in effect, an upwardly extending extension of the flange 85 at one side of the end panels. These inwardly projecting members formed on the inner surface of the end wall portions 74 serve both as extensions of the ledges 56 for engaging the end flange of the egg cartons and to form an interrupted stacking ledge defined by a V-shaped notch 86 formed in the upwardly directed terminal end thereof adjacent the inner open periphery of the crate.

Figure 9:
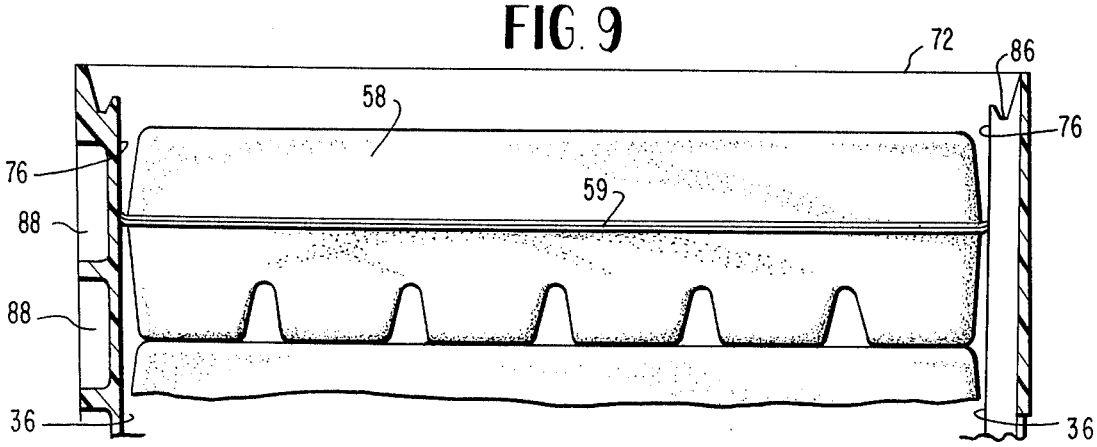
FIG. 9 is a fragmentary sectional view similar to FIG. 8 and oriented 90° with respect thereto.

As seen in FIGS. 1 and 2, recesses 88 are formed in the outer surface of the top panel portion 74 and extend into the protrusions 76 to thereby avoid areas of high mass and the problems caused thereby due to differential cooling and shrinking during the molding and shaping process. As seen in FIG. 9, the the top panel portions 90 of side walls 14, 16 also are formed with inwardly directed protrusions 92 formed thereon corresponding to the protrusions 76 on end walls 18, 20, and recesses 94 are formed in the outer surface of the top panel portion for the purposes described above. Also, a pair of openings 96 are formed in each of the top panel portions 90 of side walls 14, 16 to provide handhold or grasping means for the crate. A downwardly directed protrusion 98 is formed in one of the openings 96 in side panel 14 only and serves as an indicator, by feel, to orient the crates for stacking and nesting.

An upwardly directed V-shaped stacking groove 100 is formed in the lower end portion of the outwardly offset panel portions 38 and positioned to engage and cooperate with the upwardly directed V-shape stacking groove or notches 86 of a similar crate to stack the crates one on top of the other when the crates are oriented in the same direction.

Referring now to FIGS. 8 and 9, it is seen that the crate readily accommodates 15 one-dozen cartons of eggs arranged in five layers of three cartons each, with the open top of the crate extending substantially above the topmost layer of egg cartons 58 in the crate. The transverse width of the crate is dimensioned to receive the three cartons in side-by-side relation without substantial interference; however, the length of the crates, i.e., the horizontal distance between the end walls 18, 20, is such that the inwardly offset panel portions is slightly less than the overall length of the individual cartons, making it necessary to apply slight force to the individual cartons to slightly deflect the end portion outwardly extending flange 69 of the individual cartons as the cartons assume their position within the crates. The individual egg cartons are positioned in the crate in an inclined position, i.e., with one end lightly elevated, then rotated downward to its final horizontal position. Thus, it can be seen from FIG. 4 that only the inwardly directed ledge portions 56, which are relatively narrow, engage the end of the cartons as they are rotated into the final position, and this narrow ledge portion 56 readily cuts into or embeds itself within the outwardly extending flange 59 of the cartons 58 to firmly but releasably anchor the carton in position. Thus, the panel portions 60, 62 are strategically located to avoid applying pressure to the entire width of the end portion of the egg cartons as the carton approaches its final position in the crate since such force could damage the contents of the cartons. Also, it is noted that, due to the slight incline of the end walls, the end portion of the center flange of the egg cartons is deflected more toward the bottom of the crate than those in the upper layers. However, by maintaining the angle of inclination of the end walls as low as possible, this difference is not sufficient to damage the cartons in the bottom layer while still providing adequate interference to releasably retain the cartons in the top layers. This slight angle requires the wall thickness of the inwardly offset portion 36 to be relatively thin; however, the slightly thicker wall of the flanges 40 and the wall of the outwardly offset panel portions 38 provides adequate column strength for the wall to avoid deflection even when stacked as high as seven or eight filled crates one on top of the other and, of course, the specific configuration of the wall provides sufficient beam strength to avoid deflection under load.

Figure 6:
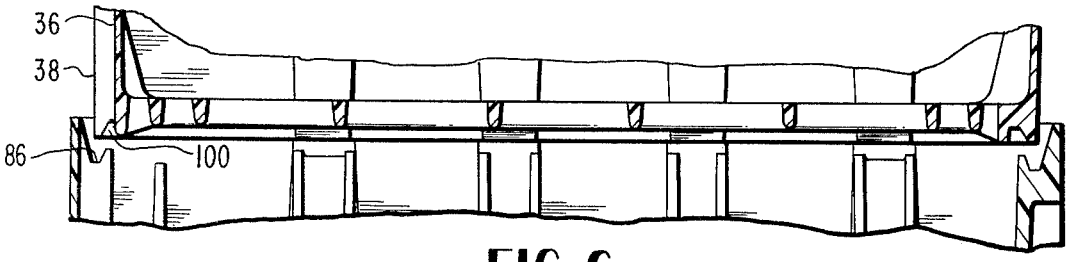
FIG. 6 is a fragmentary sectional view of two crates oriented for stacking.

As mentioned hereinabove, the marking openings 34 are provided only in one of the end panels of the crate. Since the asymmetrical arrangement of the offset portions of the side and end panels are such that, when the crates are oriented in the same direction, they stack one on top of the other as illustrated in FIG. 6 and when rotated 180° with respect to one another they will nest as shown in FIG. 5, these marking openings then serve as a visual stacking indicator. In other words, when stacking the filled crates, the end panels having the openings thereon should all be arranged in line on one vertical side of the stack whereas, when the empty crates are nested, the marking openings in alternate crates in the stack are on opposed faces of the vertical stack.

As pointed out hereinabove, a primary advantage of providing interference between the egg carton and the end walls of the crate, whereby the end walls form, in effect, releasable retaining means for the cartons, is that the filled crate may be laid over on one of the end panels so that the individual cartons are standing on end within the crate, and the interference between the carton and crate walls will prevent the cartons from tumbling out. However, the offset arrangement of the end walls, in combination with the openings in the end wall makes it easy for a customer to insert one or two fingers along the top end of the individual carton, tilt it forward and remove the carton from the crate. During this process, the remaining cartons in the layer are firmly retained in position.

Referring again to FIG. 8, it is seen that the inwardly offset panels 36 terminate, at their lower end in a section 102 that is inclined at a substantially greater angle remainder of the panel. This portion does not extend upward far enough to interfere with the nesting of the crates, and preferably is integrally joined to the web 26 to reinforce the bottom corners of the crate. Since the cartons 58 are normally inclined along this portion, the greater angle does not contact the cartons.

While we have disclosed a preferred embodiment of our invention, we wish it understood that we do not intend to be restricted solely thereto, but rather that we do intend to include all embodiments thereof which would be apparent to one skilled in the art which come within the spirit and scope of our invention.

What is claimed is:

1. An egg crate comprising:

a generally rectangular bottom panel having first, second, third and fourth edges, first, second, third and fourth upstanding side panels attached to said bottom panel, respectively along said first, second, third and fourth edges with said first and said third side panels, and said second and said fourth side panels, respectively, being opposite one another, said first and third side panels each having an upper portion and a lower portion, each of said lower portions comprising a plurality of alternating inner and outer substantially planar offset panels joined along their adjacent edges by elongated flanges, said inner offset panels being disposed in a first side plane intersecting the plane of said bottom panel and being inclined outwardly with respect thereto, said outer offset panels being disposed in a second side plane intersecting the plane of said bottom panel, the bottom edges of said outer offset panels being spaced outwardly of the bottom edges of said inner offset panels, said second side plane being inclined outwardly at a greater angle than said first side plane, said inner offset panels being generally in the configuration of an isosceles trapazoid with the longer of the two parallel sides comprising the bottom edge thereof, said outer offset panels being generally in the shape of an isosceles trapazoid with the shorter of the two parallel sides comprising the bottom edge thereof, said flanges being generally perpendicularly oriented with respect to said first and second side planes, each of said upper portions comprising a wall in a plane substantially perpendicular to said bottom panel and attached to said inner and outer offset panels, said upper portion also comprising stacking means on the inside of said wall and in alignment with said inner offset panels, said stacking means being engageable with the bottom of another of said crates when said other crate is so oriented that said first and third side panels of said other crate are aligned respectively with said third and first side panels of said crate, said stacking means further being so oriented as not to engage the bottom of said other crate when the first and third side panels of said other crate are aligned respectively with the first and third side panels of said crate.

2. The crate of claim 1 wherein said outer offset panels have a wall thickness greater than that of said inner offset panels over at least a portion thereof.

3. The crate of claim 1 wherein each of said inner offset panels comprises a plurality of generally upwardly extending narrow ledges on the inner surface thereof which are engageable with the outer extremity of egg cartons carried in said crate to releasably retain said egg cartons in position within said crate.

4. The crate of claim 3 wherein said ledges are defined on one side by said flanges and on at least portions of the other sides by a plurality of openings in said inner offset panels.

5. The crate of claim 1 wherein said stacking means comprises a plurality of inwardly oriented elongated ribs on the inner surface of said wall, said ribs originating at said inner offset panels and extending upwardly therefrom and terminating in a shoulder for engaging the bottom of another crate.

6. The crate of claim 1 wherein each of said inner offset panels has a thickened portion adjacent to said bottom panel, said thickened portion having an inner surface inclined at a greater angle than said first side plane.

7. The crate of claim 1 further comprising position indicator means disposed adjacent to the upper edge of said first side panel to facilitate alignment of a pair of said crates with said first and third side panels of one said crate aligned respectively with said third and first side panels of another said crate.

8. The crate of claim 7 wherein said stacking means comprise a plurality of shoulders of a first configuration and wherein said position indicator means comprises at least one stacking shoulder of said first side panel of a second configuration and a stacking protrusion on the bottom edge of said third side panel of said crate so configured as to be engageable only with said stacking shoulder of second configuration on another of said crates when said first and third side panels are aligned.

9. The crate of claim 8 wherein said position indicator means are offset from the centerline of said first and third side panels.

10. The crate of claim 1 wherein said second and fourth side panels are constructed like said first and third side panels.

11. The crate of claim 1 wherein said first and second side planes are spaced outwardly of the peripheral edge of said bottom panel, and wherein said inner and outer offset panels are attached to the peripheral edge of said bottom panel by a plurality of spaced struts, at least some of said struts being aligned with said flange members.

12. The crate of claim 1 wherein said bottom panel and said side panels are attached together at their contiguous edges to define four side corners and four bottom corners of the crate and wherein for at least a portion of the height of said side corners upwardly from said bottom panel, the inclination of a plane tangent to the outer surface of each of said side corners at a point bisecting the exterior angle formed by the adjacent of said side panels, with respect to a plane through said bottom panel, is greater than the inclination of the interior surface of said inner offset panels.

13. The crate of claim 12 wherein each of said side corners is curvilinear in cross-section, and the radius of curvature of each of said side corners progressively increases from the bottom toward the top of said side panels.

* * * * *